US008628435B2

(12) United States Patent
Sullivan et al.

(10) Patent No.: US 8,628,435 B2
(45) Date of Patent: Jan. 14, 2014

(54) GOLF BALL CORES BASED ON POLYALKENAMER AND POLYBUTADIENE RUBBER BLENDS

(75) Inventors: Michael J. Sullivan, Barrington, RI (US); Mark L. Binette, Mattapoisett, MA (US); Douglas S. Goguen, New Bedford, MA (US); Brian Comeau, Berkley, MA (US); Robert Blink, Newport, RI (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 455 days.

(21) Appl. No.: 12/972,758

(22) Filed: Dec. 20, 2010

(65) Prior Publication Data

US 2012/0157236 A1 Jun. 21, 2012

(51) Int. Cl.
*A63B 37/04* (2006.01)

(52) U.S. Cl.
USPC ..... 473/376; 473/371; 473/374; 525/193

(58) Field of Classification Search
None
See application file for complete search history.

(56) References Cited

U.S. PATENT DOCUMENTS

| | | | | |
|---|---|---|---|---|
| 4,683,257 | A | 7/1987 | Kakiuchi et al. | |
| 4,929,678 | A | 5/1990 | Hamada et al. | |
| 4,955,613 | A | 9/1990 | Gendreau et al. | |
| 5,082,285 | A * | 1/1992 | Hamada et al. | 473/372 |
| 5,215,308 | A | 6/1993 | Hiraoka et al. | |
| 5,585,440 | A | 12/1996 | Yamada et al. | |
| 6,139,447 | A | 10/2000 | Ohama | |
| 6,325,730 | B1 | 12/2001 | Binette et al. | |
| 6,376,612 | B1 | 4/2002 | Nesbitt et al. | |
| 6,520,870 | B2 | 2/2003 | Tzivanis et al. | |
| 6,692,379 | B2 * | 2/2004 | Morgan et al. | 473/371 |
| 6,739,985 | B2 | 5/2004 | Nesbitt | |
| 6,774,187 | B2 | 8/2004 | Voorheis et al. | |
| 6,905,423 | B2 * | 6/2005 | Morgan et al. | 473/376 |
| 6,982,301 | B1 * | 1/2006 | Voorheis et al. | 525/193 |
| 7,528,196 | B2 * | 5/2009 | Kim et al. | 525/184 |
| 2001/0005699 | A1 * | 6/2001 | Morgan et al. | 473/376 |
| 2002/0187858 | A1 * | 12/2002 | Morgan et al. | 473/374 |
| 2005/0187347 | A1 * | 8/2005 | Sullivan et al. | 525/100 |
| 2008/0090678 | A1 * | 4/2008 | Kim et al. | 473/378 |
| 2009/0191981 | A1 | 7/2009 | Kim et al. | |
| 2010/0160079 | A1 | 6/2010 | Kim et al. | |
| 2010/0304895 | A1 * | 12/2010 | Comeau et al. | 473/376 |

OTHER PUBLICATIONS

EVONIK Industries, VESTENAMER 8012 rubber with unique properties, Mar. 2009.
Struktol, Creanova —Vestenamer 8012, Oct. 12, 1999.

* cited by examiner

*Primary Examiner* — Gene Kim
*Assistant Examiner* — John E Simms, Jr.
(74) *Attorney, Agent, or Firm* — Daniel W. Sullivan

(57) ABSTRACT

Golf balls containing a core comprising a blend of: a) about 1 to about 49 weight percent of a polybutadiene rubber having a relatively high Mooney viscosity, and b) about 51 to about 99 weight percent of a polyalkenamer rubber having a relatively low Mooney viscosity are provided. Single or multi-layered cores may be prepared. In addition, the golf ball includes a cover that may be single or multi-layered. The cover is preferably made of polyurethanes, polyureas, or blends thereof. The polyalkenamer/polybutadiene rubber composition helps provide the ball with high resiliency along with a soft feel.

20 Claims, 2 Drawing Sheets

GOLF BALL CORES BASED ON POLYALKENAMER AND POLYBUTADIENE RUBBER BLENDS

BACKGROUND OF THE INVENTION

1. Field of the Invention

The present invention generally relates to golf balls and more particularly to golf balls having cores made of polyalkenamer and polybutadiene rubber blends. Single-layer and multi-layered cores may be made. The golf ball includes a cover that may be single or multi-layered. More particularly, the polyalkenamer rubber has a Mooney viscosity of less than about 10 and the polybutadiene rubber has a Mooney viscosity of about 50 to about 150.

2. Brief Review of the Related Art

Manufacturers of golf balls are constantly looking at new materials for developing multi-piece, solid balls. Basically, a two-piece solid golf ball includes a solid inner core protected by an outer cover. The inner core is made commonly of a rubber material such as natural and synthetic rubbers, styrene butadiene, polybutadiene, poly(cis-isoprene), poly(trans-isoprene), or highly neutralized acid copolymers. The outer cover is made commonly of ionomer resins, polyamides, polyesters, polyurethanes, or polyureas. In other instances, a four-piece solid golf ball having an inner core and surrounding outer core layer (dual-core) is made. The ball further includes an intermediate layer and outer cover. Five-piece balls having a dual-core, surrounding intermediate layer, and multi-layer cover comprising an inner cover and outer cover also are known in the industry. Different materials can be used to impart specific properties and features to the balls.

For example, the resiliency and rebounding performance of the golf ball is based primarily on the core of the ball. The core acts as an "engine" for the ball. In general, the rebounding performance of the ball is based on its initial velocity after being struck by the face of the golf club and its outgoing velocity after making impact with a hard surface. More particularly, the "coefficient of restitution" or "COR" of a golf ball refers to the ratio of a ball's rebound velocity to its initial incoming velocity when the ball is fired out of an air cannon into a rigid vertical plate. The COR for a golf ball is written as a decimal value between zero and one. A golf ball may have different COR values at different initial velocities. The United States Golf Association (USGA) sets limits on the initial velocity of the ball so one objective of golf ball manufacturers is to maximize COR under these conditions. Balls with a higher rebound velocity have a higher COR value. Such golf balls rebound faster, retain more total energy when struck with a club, and have longer flight distance.

Golf ball manufacturers have looked at using blends of polybutadiene rubbers to make cores. For example, Voorheis et al., U.S. Pat. Nos. 6,982,301 and 6,774,187 disclose a golf ball containing a core formed from a polybutadiene blend comprising: a) a first polybutadiene formed with a cobalt or nickel catalyst having a first Mooney viscosity between about 50 and about 150; and b) a second polybutadiene formed with a lanthanide series catalyst having a second Mooney viscosity between about 30 and about 100.

In addition, Kim et al., U.S. Pat. No. 7,528,196 and U.S. Patent Application Publication US 2009/0191981 disclose a golf ball comprising a core, cover layer, and optionally one or more inner cover layers, wherein at least one portion of the ball comprises a blend of a polyalkenamer and polyamide. The polyalkenamer/polyamide composition contains about 2 to about 90 weight % of polyalkenamer polymer and about 10 to about 98 weight % of polyamide. The '196 patent and '981 Published Application further disclose that the polyalkenamer/polyamide composition may be blended with other rubber polymers including polybutadiene, polyisoprene, polychloroprene, polybutylene, and styrene-butadiene rubber prior to molding. However, neither the '196 patent nor '981 Published Application discloses a composition comprising about 51 to about 99 weight percent of a low Mooney viscosity polyalkenamer rubber, and about 1 to about 49 weight percent of a high Mooney viscosity polybutadiene rubber.

One objective of the present invention is to develop compositions that can be used to make a core for a golf ball, wherein the core provides the ball with high resiliency along with a comfortable and soft "feel." The present invention provides golf ball core compositions having such properties as well as other advantageous characteristics, features, and benefits.

SUMMARY OF THE INVENTION

The present invention provides a golf ball comprising a core of at least one layer and cover of at least one layer, wherein the core is formed of a rubber composition comprising a blend of: a) a polybutadiene rubber having a Mooney viscosity in the range of about 55 to about 150; and b) a cycloalkene (polyalkenamer) rubber having a Mooney viscosity of less than about 10. Preferably, the cycloalkene rubber has a trans-content of 55% or greater and a melting point of 30° C. or greater and is present in an amount in the range of about 51 to about 99 weight percent based on total weight of composition. More preferably, the cycloalkene rubber has a trans-content of 75% or greater and a melting point of 50° C. or greater. In one version, the rubber composition further comprises peroxide in an amount of 2.5 phr or greater based on weight of rubber. The rubber composition helps improve core resiliency and provides the ball with a comfortable and soft feel. The core may have different constructions.

In one embodiment, a solid, single core having an outer surface and geometric center is provided, wherein the hardness of the outer surface is greater than the hardness of the geometric center to define a positive hardness gradient of at least 10 Shore C. In another embodiment, a dual-core having an inner core and surrounding outer core layer is provided. The inner core may be made of a polyalkenamer/polybutadiene rubber composition and have a positive hardness gradient. The outer core layer has a second outer surface and an inner surface and also may be made of a polyalkenamer/polybutadiene rubber composition. In one example, the hardness of the second outer surface is greater than the hardness of the inner surface to define a second positive hardness gradient. In another example, the hardness of the second outer surface is the same or less than the hardness of the inner surface to define a zero or negative hardness gradient. Different compositions may be used to form the outer cover of the golf ball including polyurethanes, polyureas, and hybrids, copolymers, and blends thereof. The cover may be multi-layered; for example, the cover may include an inner cover made of an ethylene-based ionomer resin and an outer cover made of a polyurethane or polyurea.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
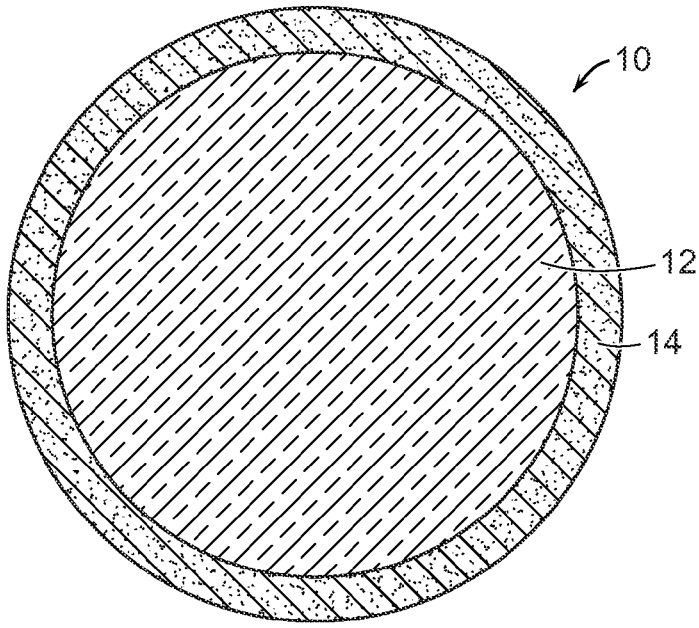
FIG. 1 is a cross-sectional view of a two-piece golf ball having an inner core made of a polyalkenamer/polybutadiene rubber composition and a cover layer made of polyurethane in accordance with the present invention.

The present invention relates generally to golf balls containing a core made from a rubber composition, wherein the rubber composition is a blend comprising: a) cycloalkene (polyalkenamer) rubber having a Mooney viscosity of less than about 10 in an amount of about 51 to about 99 weight percent, and b) polybutadiene rubber having a Mooney viscosity of about 50 to about 150 in an amount of about 1 to about 49 weight percent.

Golf balls having various constructions may be made in accordance with this invention. For example, golf balls having two-piece, three-piece, four-piece, and five-piece constructions with single or multi-layered cores and cover materials may be made The term, "layer" as used herein means generally any spherical portion of the golf ball. More particularly, in one version, a three-piece golf ball having a solid center (otherwise referred to as an inner core) and a multi-layered cover (having an inner cover layer and outer cover layer) is made. In another version, a four-piece golf ball comprising a dual-core having an inner core and a surrounding outer core layer and a multi-layered cover is made. In yet another construction, a five-piece golf ball having a dual-core, intermediate layer, and multi-layered cover is made. The diameter and thickness of the different layers along with properties such as hardness and compression may vary depending upon the construction and desired playing performance properties of the golf ball. The core may contain sections having substantially the same hardness or different hardness levels. That is, there can be substantially uniform hardness throughout the different sections of the core or there can be hardness gradients as discussed in further detail below.

High Mooney Viscosity Polybutadiene Rubbers

The polybutadiene rubber used as a component in the blend of the present invention preferably has a relatively high Mooney viscosity. A "Mooney unit" is an arbitrary unit used to measure the viscosity of raw or unvulcanized rubber. In the present invention, the Mooney viscosity is measured in accordance with "Standard Test Methods for Rubber-Viscosity, Stress Relaxation, and Pre-Vulcanization Characteristics (Mooney Viscometer)" of ASTM D1646-07.

The polybutadiene rubber preferably has a relatively high Mooney viscosity of from about 50 to about 150, more preferably from about 60 to about 130, and most preferably from about 70 to about 105. In particular versions, the lower limit of viscosity for the high Mooney viscosity polybutadiene rubber may be 50 or 55 or 60 or 70 or 75 or 80 or 85 or 90; and the upper limit may be 95 or 100 or 105 or 110 or 115 or 120 or 125 or 130. The polyalkenamer rubber has a Mooney viscosity lower than that of the polybutadiene rubber as discussed further below. Particularly, the polyalkenamer rubber has a Mooney viscosity of less than about 10 and more particularly less than about 5.

Examples of commercially available polybutadiene rubbers that can be used in accordance with this invention; provided they have the required Mooney viscosity, include, but are not limited to, BUDENE 1207 and 1207s, available from Goodyear, Inc of Akron, Ohio; BR 730, available from Japan Synthetic Rubber (JSR) of Tokyo, Japan; BUNA CB 21, CB 22, CB 23, CB 60, CB Nd 60, CB 55 NF, CB 70 B, CB KA 8967, and CB 1221, available from Lanxess Corp. of Pittsburgh. Pa.; UBEPOL BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and MEODENE BR50 and BR60, available from Karbochem (PTY) Ltd. of Bruma, South Africa; NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic. A preferred base rubber is 1,4-polybutadiene having a cis-bond structure of at least 40%, preferably greater than 80%, and more preferably greater than 90%. A preferred base rubber should also have a stress relaxation time ($T_{80}$) of 10 seconds or less, preferably 6 seconds or less, and more preferably 4 seconds or less. Stress relaxation time ($T_{80}$) is defined as the time in seconds from the moment when the rotation is stopped immediately after measurement of the Mooney Viscosity (as measured in accordance with ASTM D-1646-07) that is required for the Mooney value to decrease 80%.

Low Mooney Viscosity Polyalkenamer Rubbers

Suitable cycloalkene rubbers that can be used in the compositions of this invention are rubbery polymers made from one or more cycloalkenes having from 5 to 20, preferably 5 to 15, ring carbon atoms. Cycloalkene rubbers are rubbery polymers made from one or more cycloalkenes having from 5 to 20, preferably 5 to 15, ring carbon atoms. The cycloalkene rubbers (also referred to as polyalkenylene or polyalkenamer rubbers) may be prepared by ring opening metathesis polymerization of one or more cycloalkenes in the presence of organometallic catalysts as is known in the art. Such polymerization methods are disclosed, for example, in U.S. Pat. Nos. 3,492,245 and 3,804,803, the disclosures of which are hereby incorporated by reference. By the term, "cycloalkene rubber" as used herein, it is meant a compound having at least 20 weight % macrocycles (cyclic content). The cyclic and linear portions of the cycloalkene rubber have the following general chemical structures:

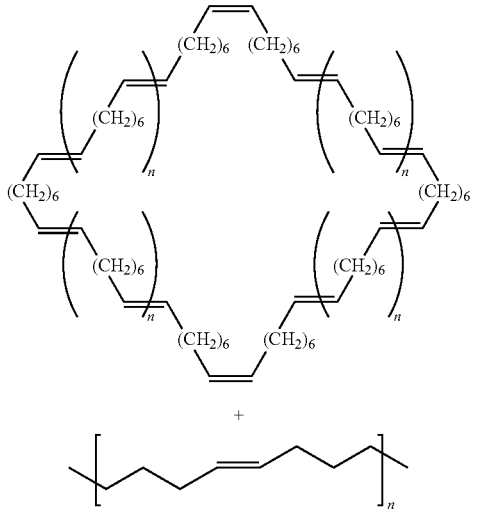

$n$ = 30-10000

Suitable cyclic olefins that can be used to make the cycloalkene rubber include unsaturated hydrocarbons with 4 to 12 ring carbon atoms in one or more rings e.g., 1-3 rings, which exhibit in at least one ring an unsubstituted double bond which is not in conjugation to a second double bond which may be present and which may have any degree of substitution; the substituents must not interfere with the metathesis catalysts and are preferably alkyl groups of 1 to 4 carbon atoms or a part of a cyclic structure of 4 to 8 carbon atoms. Examples are cyclobutene, cyclopentene, cycloheptene, cis- and trans-cyclooctene, cyclononene, cyclodecene, cycloundecene, cis- and trans-cyclododecene, cis, cis-cyclooctadiene, 1-methyl-1,5-cyclooctadiene, 3-methyl-1,5-cyclooctadiene, and 3,7-dimethyl-1,5-cyclooctadiene.

Examples of suitable polyalkenamer rubbers are polypentenamer rubber, polyheptenamer rubber, polyoctenamer rubber, polydecenamer rubber and polydodecenamer rubber. Polyoctenamer rubbers are commercially available from Evonik Degussa GmbH of Marl, Germany and sold under the VESTENAMER tradename. The polyalkenamer rubber used in the present invention preferably has a trans-bond content of about 55% or greater and a second heat melting point of about 30° C. or greater. More preferably, the cycloalkene rubber has a trans-bond content of 75% or greater and a second heat melting point of 50° C. or greater. Furthermore, the polyalkenamer rubber material preferably has a molecular weight of about 80,000 or greater (measured according to GPC); a glass transition temperature (Tg) of about 55° C. or less (measured according to ISO 6721 or 4663); a cis-to-trans ratio of double bonds of about 40:60 or preferably about 20:80 (measured according to IR); a viscosity number J/23° C. of about 130 or preferably about 120 ml/g (measured according to ISO 1628-1); and a density of about 0.9 g/cm$^3$ or greater (measured according to DIN 53 479 A or ISO 1183).

The polyalkenamer rubber compound, of and by itself, has relatively high crystallinity. For example, a specific grade of polyalkenamer rubber (VESTENAMER 8012) has a crystallinity of approximately 30% (measured by DSC, second melting.) The ratio of cis double bonds to trans double bonds (cis/trans ratio) in the polymer is significant in determining the degree of crystallinity in the polymer. In general, if the trans-bond content of the polymer is relatively high, the crystallinity and melting point of the polymer is relatively high. That is, as the trans-bond content increases, the crystallinity of the polymer increases. The polyalkenamer rubber, VESTENAMER 8012 has a trans-bond content of about 80%. In accordance with the present invention, it has been found the compression of polyalkenamer/polybutadiene rubber cores is reduced and the Coefficient of Restitution ("COR") of the cores is increased when the rubber composition is cross-linked to a relatively high degree and the composition does not contain a reactive cross-linking co-agent such as zinc diacrylate (ZDA). The polyalkenamer rubber composition may be cured using a conventional curing process such as peroxide-curing, sulfur-curing, and high-energy radiation, and combinations thereof. For example, the composition may be peroxide-cured. When peroxide is added at relatively high amounts (particularly, at least 2.5 and preferably 5.0 phr) and the composition (which if it does not contain a reactive cross-linking co-agent such as ZDA) is cured to cross-link the rubber chains, then the compression of the polyalkenamer rubber cores is reduced and the COR of the cores is increased. It is believed this phenomenon is due, at least in part, to disrupting the crystalline structure of the polymer by curing and cross-linking the composition in accordance with this invention. While not wishing to be bound by any theory, it is believed the cross-linking disrupts the crystallinity of the material. It appears the crystallinity may be partially disrupted and the polymer remains in a partially crystalline state. As a result, the polyalkenamer rubber (in the absence of a reactive cross-linking agent co-such as ZDA) becomes softer and more rubbery and the compression of core samples made from the composition decreases.

One example of a commercially-available material that can be used in accordance with this invention is VESTENAMER 8012 (trans-bond content of about 80% and a melting point of about 54° C.). The material, VESTENAMER 6213 (trans-bond content of about 60% and a melting point of about 30°) also may be effective.

The polyalkenamer rubber is used in an amount of at least 51% by weight based on total amount of polymer in the rubber composition used to make the core. Preferably, the polyalkenamer rubber is present in an amount of 65 to 95% by weight and more preferably 75 to 98% by weight based on total polymer weight. In particular versions, the blend may contain a lower concentration of polylalkenamer rubber in the amount of 55%, 60%, 65%, or 70% and an upper concentration of polyalkenamer in the amount of 75%, 80%, 85%, 90%, or 95%.

In the present invention, it has been found that rubber compositions comprising a blend of relatively high Mooney viscosity polybutadiene and relatively low Mooney viscosity polyalkenamer rubbers are particularly effective for providing cores having high resiliency and good processability. The rubber compositions can be used to make a core that provides the golf ball with good rebounding properties (distance) without sacrificing a nice feel to the ball. The resulting ball has a relatively high COR allowing it to reach high velocity when struck by a golf club. Thus, the ball tends to travel a greater distance which is particularly important for driver shots off the tee. Meanwhile, the soft feel of the ball provides the player with a more pleasant sensation when he/she strikes the ball with the club. In general, the cores of this invention typically have a COR of about 0.76 or greater; and more preferably about 0.80 or greater. The compression of the cores preferably is about 40 or greater; and more preferably in the range of about 50 to about 110.

Moreover, the molding processability of the high Mooney viscosity polybutadiene/low Mooney viscosity polyalkenamer rubber blend is good. Normally, there are some processability problems with handling high Mooney viscosity polybutadiene. There can be problems such as die swelling and cold flow when using high Mooney viscosity polybutadiene. In accordance with this invention, making a blend of high Mooney viscosity polybutadiene and low Mooney viscosity polyalkenamer helps to enhance overall processability of the composition.

Curing of Composition

The rubber compositions of this invention may be cured using conventional curing processes. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of total rubber.

In one preferred version, the peroxide free-radical initiator is present in an amount of at least 2.5 and more preferably 5 parts per hundred (phr). As discussed above, it is believed the high crystallinity of the polyalkenamer rubber is reduced by adding the peroxide at relatively high amounts to the rubber composition and curing the composition so it is cross-linked. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

The rubber composition may further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the total rubber.

Radical scavengers such as a halogenated organosulfur, organic disulfide, or inorganic disulfide compounds may be added to the rubber composition. These compounds also may function as "soft and fast agents." As used herein, "soft and fast agent" means any compound or a blend thereof that is capable of making a core: 1) softer (having a lower compression) at a constant "coefficient of restitution" (COR); and/or 2) faster (having a higher COR at equal compression), when compared to a core equivalently prepared without a soft and fast agent. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The rubber compositions of the present invention also may include "fillers," which are added to adjust the density and/or specific gravity of the material. Suitable fillers include, but are not limited to, polymeric or mineral fillers, metal fillers, metal alloy fillers, metal oxide fillers and carbonaceous fillers. Fillers can be in the form of flakes, fibers, fibrils, or powders. Regrind, which is ground, recycled core material (for example, ground to about 30 mesh particle size), can also be used. The amount and type of fillers utilized are governed by the amount and weight of other ingredients in the golf ball, since a maximum golf ball weight of 45.93 g (1.62 ounces) has been established by the United States Golf Association (USGA). Suitable fillers generally have a specific gravity from about 2 to 20. In one preferred embodiment, the specific gravity can be about 2 to 6.

Suitable polymeric or mineral fillers include, for example, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used.

Other additives and fillers include, but are not limited to, chemical blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, tungsten, tungsten carbide, silica, lead silicate, regrind (recycled material), clay, mica, talc, nano-fillers, carbon black, glass flake, milled glass, and mixtures thereof. Suitable additives are more fully described in, for example, Rajagopalan et al., U.S. Patent Application Publication No. 2003/0225197, the entire disclosure of which is hereby incorporated herein by reference. In a particular embodiment, the total amount of additive(s) and filler(s) present in the polyalkenamer rubber composition is 15 wt % or less, or 12 wt % or less, or 10 wt % or less, or 9 wt % or less, or 6 wt % or less, or 5 wt % or less, or 4 wt % or less, or 3 wt % or less, based on the total weight of the rubber composition. In a particular aspect of this embodiment, the polyalkenamer rubber composition includes filler(s) selected from carbon black, nanoclays (e.g., Cloisite® and Nanofil® nanoclays, commercially available from Southern Clay Products, Inc., and Nanomax® and Nanomer® nanoclays, commercially available from Nanocor, Inc.), talc (e.g., Luzenac HAR® high aspect ratio talcs, commercially available from Luzenac America, Inc.), glass (e.g., glass flake, milled glass, and microglass), mica and mica-based pigments (e.g., Iriodin® pearl luster pigments, commercially available from The Merck Group), and combinations thereof. In a particular embodiment, the polyalkenamer rubber composition is modified with organic fiber micropulp, as disclosed, for example, in Chen, U.S. Pat. No. 7,504,448, the entire disclosure of which is hereby incorporated by reference.

In addition, the rubber compositions may include antioxidants to prevent the breakdown of the elastomers. Also, processing aids such as high molecular weight organic acids and salts thereof, may be added to the composition. Suitable organic acids are aliphatic organic acids, aromatic organic acids, saturated mono-functional organic acids, unsaturated monofunctional organic acids, multi-unsaturated mono-functional organic acids, and dimerized derivatives thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The organic acids are aliphatic, mono-functional (saturated, unsaturated, or multi-unsaturated) organic acids. Salts of these organic acids may also be employed. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, and salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending.)

Other ingredients such as accelerators (for example, tetra methylthiuram), processing aids, dyes and pigments, wetting agents, surfactants, plasticizers, coloring agents, fluorescent agents, chemical blowing and foaming agents, defoaming agents, stabilizers, softening agents, impact modifiers, antioxidants, antiozonants, as well as other additives known in the art may be added to the rubber composition. The core may be formed by mixing and molding the rubber composition using conventional techniques. These cores can be used to make finished golf balls by surrounding the core with outer core layer(s), intermediate layer(s), and/or cover materials as discussed further below.

The polyalkenamer/polybutadiene rubber composition may be blended with other rubber and polymeric materials. As described above, these rubber materials include, but are not limited to, polybutadiene, polyisoprene, ethylene propylene rubber ("EPR"), ethylene propylene diene rubber ("EPDM"), styrene-butadiene rubber, styrenic block copolymer rubbers (such as SI, SIS, SB, SBS, SIBS, SEBS, and the like, where "S" is styrene, "I" is isobutylene, "B" is butadiene, and "E" is ethylene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Other suitable core materials include highly neutralized polymers (HNPs) neutralized with organic fatty acids and salts thereof, metal cations, or a combination of both. The core may also comprise thermosetting or thermoplastic materials such as polyurethanes, polyureas, and partially or fully neutralized ionomers. The core may be formed by mixing and forming the rubber composition using conventional techniques.

More particularly, the core compositions may be formed by mixing the materials described above. After the mixing has been completed, the golf ball core composition is milled and hand-prepped or extruded using a machine into pieces ("preps") suitable for molding. The milled preps are then compression molded into cores at an elevated temperature, typically 320° F. for 15 minutes at 2,500 lbs of pressure. The cores can be used to make finished golf balls by surrounding the cores with intermediate and cover layers in accordance with this invention. Golf balls containing multi-layered cores, particularly dual cores, also may be made in accordance with this invention. Methods for forming dual cores are disclosed in U.S. Pat. Nos. 6,180,040 and 6,180,722, the disclosures of which are hereby incorporated by reference.

Intermediate and Cover Layers

The golf balls of this invention preferably include at least one intermediate layer. As used herein, the term, "intermediate layer" means a layer of the ball disposed between the core and cover. The intermediate layer may be considered an outer core layer, or inner cover layer, or any other layer disposed between the inner core and outer cover of the ball. The intermediate layer also may be referred to as a casing or mantle layer. Preferably, the intermediate layer has water vapor barrier properties to prevent moisture from penetrating into the rubber core. The ball may include one or more intermediate layers disposed between the inner core and outer cover. The intermediate layer can be made of any suitable material known in the art including thermoplastic or thermosetting materials, particularly ionomeric and non-ionomeric resins.

In general, ionomer resins refer to copolymers of α-olefin; $C_3$ to $C_8$ α,β-ethylenically unsaturated mono- or dicarboxylic acid; and optional softening monomer. The α-olefin is preferably ethylene or $C_3$ to $C_8$. These ionomers may be prepared by methods known in the art. Copolymers may include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl(meth)acrylate, ethylene/(meth)acrylic acid/iso-butyl(meth)acrylate, ethylene/(meth)acrylic acid/methyl(meth)acrylate, ethylene/(meth)acrylic acid/ethyl(meth)acrylate terpolymers, and the like. The term "copolymer," as used herein, includes polymers having two types of monomers, those having three types of monomers, and those having more than three types of monomers. Preferred α,β-ethylenically unsaturated mono- or dicarboxylic acids are (meth)acrylic acid, ethacrylic acid, maleic acid, crotonic acid, fumaric acid, itaconic acid. (Meth)acrylic acid is most preferred. As used herein, "(meth)acrylic acid" means methacrylic acid and/or acrylic acid. Likewise, "(meth)acrylate" means methacrylate and/or acrylate.

When a softening monomer is included, such copolymers are referred to herein as E/X/Y-type copolymers, wherein E is ethylene; X is a $C_3$ to $C_8$ α,β-ethylenically unsaturated mono- or dicarboxylic acid; and Y is a softening monomer. The softening monomer is typically an alkyl(meth)acrylate, wherein the alkyl groups have from 1 to 8 carbon atoms. Preferred E/X/Y-type copolymers are those wherein X is (meth)acrylic acid and/or Y is selected from (meth)acrylate, n-butyl(meth)acrylate, isobutyl(meth)acrylate, methyl(meth) acrylate, and ethyl(meth)acrylate. More preferred E/X/Y-type copolymers are ethylene/(meth)acrylic acid/n-butyl acrylate, ethylene/(meth)acrylic acid/methyl acrylate, and ethylene/(meth)acrylic acid/ethyl acrylate.

The amount of ethylene or $C_3$ to $C_6$ α-olefin in the acid copolymer is typically at least 15 wt. %, preferably at least 25 wt. %, more preferably least 40 wt. %, and even more preferably at least 60 wt. %, based on the total weight of the copolymer. The amount of $C_3$ to $C_8$ α,β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on the total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on the total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties.

The acidic groups in the copolymeric ionomers are partially or totally neutralized with a cation source. Suitable cation sources include metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof. The metal cation salts provide the cations capable of neutralizing (at varying levels) the carboxylic acids of the ethylene acid copolymer and fatty acids (if present.) These include, for example, the sulfate, carbonate, acetate, oxide, or hydroxide salts of the above-described metals. The amount of cation used in the composition is readily determined based on desired level of neutralization. For example, ionomeric resins having acid groups that are neutralized from about 10 percent to about 100 percent may be used. In one embodiment, the acid groups are partially neutralized. That is, the neutralization level is from about 10 to about 80%, more preferably 20 to 70%, and most preferably 30 to 50%. In another embodiment, the acid groups are highly or fully neutralized. That is, the neutralization level is from about 80 to about 100%, more preferably 90 to 100%, and most preferably 95 to 100%.

It is also known that organic acids or salts of organic acids, particularly fatty acids, may be added to the ionomer resin to help make the composition more processable. This may be accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%). The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, and salts of fatty acids, particularly stearic, behenic, erucic, oleic, linoelic or dimerized derivatives thereof. It is preferred that the organic acids and salts be relatively non-migratory (they do not bloom to the surface of the polymer under ambient temperatures) and non-volatile (they do not volatilize at temperatures required for melt-blending).

In one embodiment, the golf ball includes a multi-layered cover comprising inner and outer cover layers. The inner cover layer is preferably formed from a composition comprising an ionomer or a blend of two or more ionomers that help impart hardness to the ball. In a particular embodiment, the inner cover layer is formed from a composition comprising a high acid ionomer. A particularly suitable high acid ionomer is Surlyn 8150® (DuPont). Surlyn 8150® is a copolymer of ethylene and methacrylic acid, having an acid content of 19 wt %, which is 45% neutralized with sodium. In another particular embodiment, the inner cover layer is formed from a composition comprising a high acid ionomer and a maleic anhydride-grafted non-ionomeric polymer. A particularly suitable maleic anhydride-grafted polymer is Fusabond 525D® (DuPont). Fusabond 525D® is a maleic anhydride-grafted, metallocene-catalyzed ethylene-butene copolymer having about 0.9 wt % maleic anhydride grafted onto the copolymer. A particularly preferred blend of high acid ionomer and maleic anhydride-grafted polymer is an 84 wt %/16 wt % blend of Surlyn 8150® and Fusabond 525D®. Blends of high acid ionomers with maleic anhydride-grafted polymers are further disclosed, for example, in U.S. Pat. Nos. 6,992,135 and 6,677,401, the entire disclosures of which are hereby incorporated herein by reference.

In one embodiment, the inner cover layer is preferably formed from a composition comprising a 50/45/5 blend of Surlyn® 8940/Surlyn® 9650/Nucrel® 960, and, in a particularly preferred embodiment, has a material hardness of from 80 to 85 Shore C. In another particular embodiment, the inner cover layer is preferably formed from a composition comprising a 50/25/25 blend of Surlyn® 8940/Surlyn® 9650/Surlyn® 9910, preferably having a material hardness of about 90 Shore C. In yet another particular embodiment, the inner cover layer is preferably formed from a composition comprising a 50/50 blend of Surlyn® 8940/Surlyn® 9650, preferably having a material hardness of about 86 Shore C. Surlyn® 8940 is an E/MAA copolymer in which the MAA acid groups have been partially neutralized with sodium ions. Surlyn® 9650 and Surlyn® 9910 are two different grades of E/MAA copolymer in which the MAA acid groups have been partially neutralized with zinc ions. Nucrel® 960 is an E/MAA copolymer resin nominally made with 15 wt % methacrylic acid.

The intermediate layer also may be formed of highly-neutralized polymers (HNP). In a preferred embodiment, at least one intermediate layer of the golf ball is formed from an HNP material or a blend of HNP materials. The acid moieties of the HNPs, typically ethylene-based ionomers as described above, are preferably neutralized greater than about 70%, more preferably greater than about 90%, and most preferably at least about 100%. Suitable cation sources include metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof.

The ionomeric resin may be blended with non-ionomeric thermoplastic resins. Suitable non-ionomeric thermoplastic resins include, without limitation, thermoplastic elastomers, such as polyurethane, poly-ether-ester, poly-amide-ether, polyether-urea, Pebax® (a family of block copolymers based on polyether-block-amide, available from Arkema, Inc.; styrene-butadiene-styrene (SBS) block copolymers, styrene-(ethylene-butylene)-styrene block copolymers, and the like, polyamide (oligomeric and polymeric), polyesters, polyolefins including polyethylene, polypropylene, ethylene/propylene copolymers, and the like, ethylene copolymers with various comonomers, such as vinyl acetate, (meth)acrylates, (meth)acrylic acid, and epoxy-functionalized monomers, polycarbonates, acrylics, such as methyl methacrylate homopolymers or copolymers, polystyrene, polymers functionalized with maleic anhydride, epoxidization, and the like, either by copolymerization or by grafting, elastomers such as EPDM, metallocene catalyzed PE and copolymer, ground-up powders of the thermoset elastomers, and the like.

Suitable materials for forming the cover layer include, for example, polyurethanes; polyureas; copolymers and hybrids of polyurethane and polyurea; olefin-based copolymer ionomer resins (for example, Surlyn® ionomer resins and DuPont HPF® 1000 and HPF® 2000, available from DuPont; Iotek® ionomers, commercially available from ExxonMobil Chemical Company; Amplify® JO ionomers of ethylene acrylic acid copolymers, commercially available from The Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from DuPont; polyurethane-based thermoplastic elastomers, such as Elastollan®, commercially available from BASF; synthetic or natural vulcanized rubber; and combinations thereof. Castable polyurethanes, polyureas, and copolymers and hybrids of polyurethane and polyurea are of particular interest, because these materials can be used to make a golf ball having high resiliency and a soft feel. By the term, "hybrids of polyurethane and polyurea," it is meant to include copolymers and blends thereof.

Polyurethanes, polyureas, and blends, copolymers, and hybrids of polyurethane/polyurea are also particularly suitable for forming cover layers. When used as cover layer materials, polyurethanes and polyureas can be thermoset or thermoplastic. Theimoset materials can be formed into golf ball layers by conventional casting or reaction injection molding techniques. Thermoplastic materials can be formed into golf ball layers by conventional compression or injection molding techniques.

Golf Ball Construction

In one preferred version of the golf ball, the core is a single-core constituting a solid core having a "positive" hardness gradient (that is, the outer surface of the core is harder than its geometric center.) In a second preferred embodiment, the core is a dual-core comprising an inner core and a surrounding outer core layer. For example, the inner core may have a positive hardness gradient and the outer core layer also may have a positive hardness gradient. In another example, the inner core has a "positive" hardness gradient and the outer core layer has a "negative" hardness gradient (that is, the outer surface of the outer core layer is softer than the inner surface of the outer core layer.) Other embodiments of golf balls having various combinations of positive, negative, and zero hardness gradients may be made in accordance with this invention. In another example, the inner core may have a positive hardness gradient and the outer core layer may have a "zero" hardness gradient. (That is, the hardness values of the outer surface of the outer core layer and the inner surface of the outer core layer are substantially the same.) Particularly, the term, "zero hardness gradient" as used herein, means a surface to center Shore C hardness gradient of less than 8, preferably less than 5 and most preferably less than 3 and may have a value of zero or negative 1 to negative 25. The term, "negative hardness gradient" as used herein, means a surface to center Shore C hardness gradient of less than zero. The terms, zero hardness gradient and negative hardness gradient, may be used herein interchangeably to refer to hardness gradients of negative 1 to negative 25. The term, "positive hardness gradient" as used herein, means a surface to center Shore C hardness gradient of 8 or greater, preferably 10 or greater, and most preferably 20 or greater. By the term, "steep positive hardness gradient" as used herein, it is meant surface to center Shore C hardness gradient of 20 or greater, more preferably 25 or greater, and most preferably 30 or greater. For example, the core may have a steep positive hardness gradient of 35, 40, or 45 Shore C or greater. Methods for measuring the hardness of the inner core and surrounding layers and determining the hardness gradients are discussed in further detail below.

In one embodiment, the golf ball has a solid, single-core; an intermediate layer; and a cover layer. When a single-layered core is used, the core preferably has a diameter within a range having a lower limit of 1.40 or 1.45 or 1.50 or 1.51 or 1.53 inches and an upper limit of 1.55 or 1.59 or 1.60 or 1.62 or 1.66 inches, and more preferably has a diameter within a range having a lower limit of 1.51 or 1.53 inches and an upper range of 1.55 or 1.59 inches. In a particularly preferred embodiment, the core has a diameter of about 1.53 inches.

In another embodiment, the golf ball has a dual-core (that is, a two-layered core) and a dual (two-layered) cover enclosing the core. In yet another version, a five-piece golf ball may be made having a dual core, and intermediate layer, and a dual cover. The dual-core constitutes an inner core (center) and an outer core layer. The inner core has a diameter within a range having a lower limit of 0.75 or 0.85 or 0.875 inches and an upper limit of 1.125 or 1.15 or 1.39 inches. The outer core layer encloses the inner core such that the two-layer core has an overall diameter within a range having a lower limit of 1.40 or 1.50 or 1.51 or 1.52 or 1.525 inches and an upper limit of 1.54 or 1.55 or 1.555 or 1.56 or 1.59 inches.

When a single-layered core is used, the core preferably has a center hardness within a range having a lower limit of 30 or 40 or 45 Shore C and an upper limit of 70 or 75 or 80 Shore C. The surface hardness of the core is preferably greater than 70 Shore C, or 75 Shore C or greater, 80 Shore C or greater, 85 Shore C or greater, or 90 Shore C or greater. In a particular embodiment, the surface hardness of the core is greater than the center hardness of the core to define a positive hardness gradient and more preferably the surface hardness of the core is at least 10 Shore C units greater than the center hardness of the core.

When a dual-layered core is used, the inner core (center) preferably has a geometric center hardness within a range having a lower limit of 50 or 55 or 60 Shore C and an upper limit of 65 or 70 or 80 Shore C. Meanwhile, the outer core layer preferably has an outer surface hardness of 75 Shore C or greater, or 80 Shore C or greater, or 85 Shore C or greater, or 90 Shore C or greater. And, the inner surface of the outer core preferably has a surface hardness within a range having a lower limit of 55, 60, 65, 70, or 75 Shore C and an upper limit of 80, 85, or 90 Shore C.

The intermediate (or inner cover) layer preferably has a material hardness within a range having a lower limit of 70 or 75 or 80 or 82 Shore C and an upper limit of 85 or 86 or 90 or 92 Shore C. The thickness of the intermediate layer is preferably within a range having a lower limit of 0.010 or 0.015 or 0.020 or 0.030 inches and an upper limit of 0.035 or 0.045 or 0.080 or 0.120 inches. The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches. Methods for measuring hardness of the layers in the golf ball are described in further detail below.

As discussed above, the single-layered core of this invention may be enclosed with one or more cover layers. The inner cover layer(s) may be referred to as intermediate layers. In one embodiment, a multi-layered cover comprising inner and outer cover layers is formed, where the inner cover layer has a thickness of about 0.01 inches to about 0.06 inches, more preferably about 0.015 inches to about 0.040 inches, and most preferably about 0.02 inches to about 0.035 inches. In this version, the inner cover layer is formed from a partially- or fully-neutralized ionomer having a Shore D hardness of greater than about 55, more preferably greater than about 60, and most preferably greater than about 65. The outer cover layer, in this embodiment, preferably has a thickness of about 0.015 inches to about 0.055 inches, more preferably about 0.02 inches to about 0.04 inches, and most preferably about 0.025 inches to about 0.035 inches, with a hardness of about Shore D 80 or less, more preferably 70 or less, and most preferably about 60 or less. The inner cover layer is harder than the outer cover layer in this version. A preferred outer cover layer is a castable or reaction injection molded polyurethane, polyurea or copolymer, blend, or hybrid thereof having a Shore D hardness of about 40 to about 50. In another multi-layer cover, single core embodiment, the outer cover and inner cover layer materials and thickness are the same but, the hardness range is reversed, that is, the outer cover layer is harder than the inner cover layer.

Figure 2:
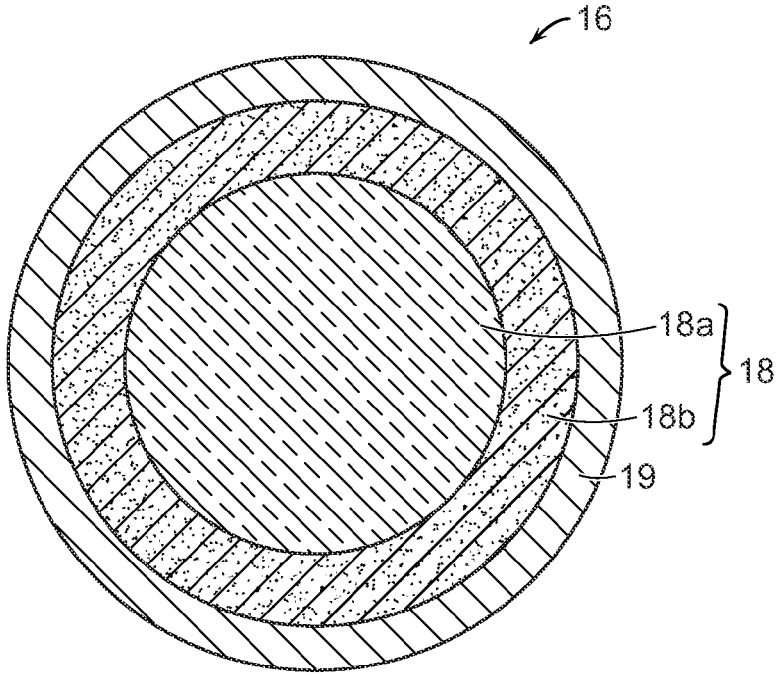
FIG. 2 is a cross-sectional view of a three-piece golf ball having a dual-core comprising an inner core and outer core made of polyalkenamer/polybutadiene rubber compositions and a cover layer made of polyurethane in accordance with the present invention.
Figure 3:
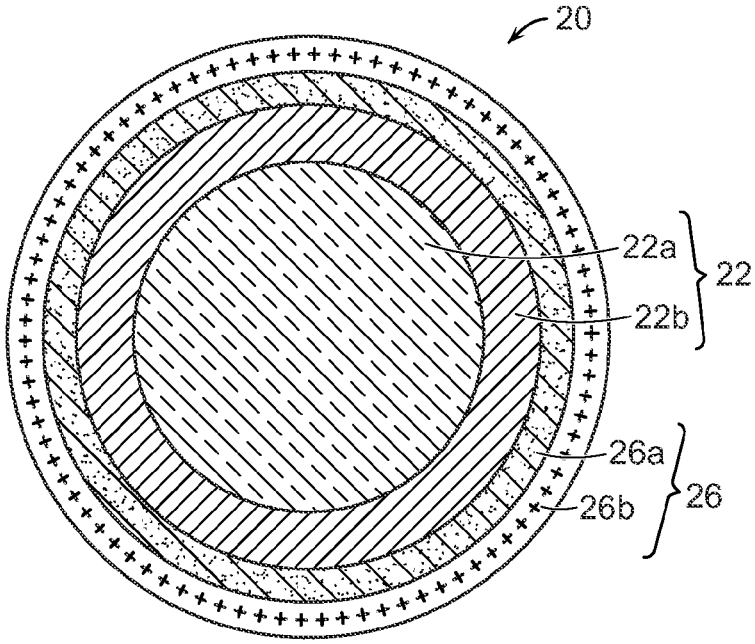
FIG. 3 is a cross-sectional view of a four-piece golf ball having a dual-core comprising an inner core and outer core made of polyalkenamer/polybutadiene rubber compositions; an inner cover layer made of an ethylene-based acid ionomer; and an outer cover layer made of polyurethane in accordance with the present invention.
Figure 4:
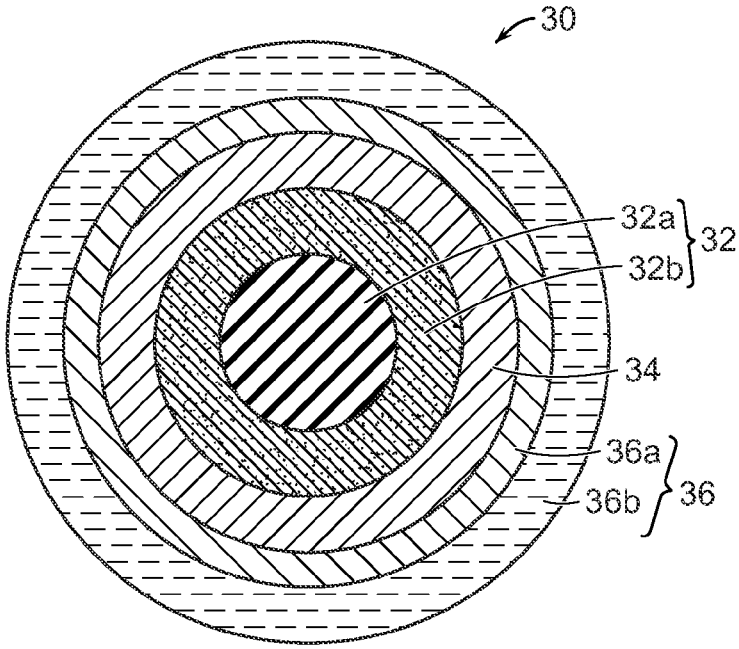
FIG. 4 is a cross-sectional view of a five-piece golf ball having a dual-core comprising an inner core and outer core made of polyalkenamer/polybutadiene rubber compositions made in accordance with the present invention.

As discussed above, the polyalkenamer rubber materials of this invention may be used with any type of ball construction known in the art. Such golf ball designs include, for example, two-piece, three-piece, four-piece, and five-piece designs. The core, intermediate casing, and cover material can be single or multi-layered. Referring to FIG. 1, one version of a golf ball that can be made in accordance with this invention is generally indicated at (10). In this two-piece golf ball (10), the ball includes a solid, single-layered core (12) made of the polyalkenamer/polybutadiene rubber composition and a cover layer (14) made of polyurethane. In FIG. 2, a three-piece ball (16) comprising a dual-core (18) having an inner core (18a) and outer core layer (18b) along with a cover (19) is shown. In another embodiment, as shown in FIG. 3, the four-piece golf ball (20) contains a dual-core (22) comprising an inner core (22a) and outer core layer (22b). The golf ball (20) further includes a multi-layer cover (26) comprising inner cover (26a) and outer cover (26b) layers. Turning to FIG. 4 in yet another version, a five-piece golf ball (30) containing a dual-core (32) comprising an inner core (32a) and outer core layer (32b) can be made. This ball includes an intermediate layer (34) and a multi-layered cover (36) comprising an inner cover layer (36a) and outer cover layer (36b). It should be understood the golf balls shown in FIGS. 1-4 are for illustrative purposes only and are not meant to be restrictive. It should be recognized that other golf ball constructions can be made in accordance with this invention.

Test Methods

Hardness. The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

Compression. As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton. Compression may be measured as described in McNamara et al., U.S. Pat. No. 7,777,871, the disclosure of which is hereby incorporated by reference.

Coefficient of Restitution ("COR"). The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculated as the ratio of the ball's outgoing transit time period to the ball's incoming transit time period ($COR=V_{out}N_{in}=T_{in}/T_{out}$).

EXAMPLES

It should be understood that the examples below are for illustrative purposes only and should not be construed as limiting the scope of the invention.

Example 1

In this Example, a slug of a rubber composition having the formulation described in Table 1 was cured at about 350° F. for about 11 minutes to make a solid, single-layered core. The resulting core had a center hardness of about 57 Shore C and a surface hardness of about 89 Shore C providing a positive hardness gradient. In addition, the core had a compression of about 90 and a COR of about 0.790 @125 f/s (1.550 inch diameter solid sphere.)

TABLE 1

(Core Compositions)

| Core Composition | Concentration (parts per hundred) |
|---|---|
| Vestenamer ® 8012 - polyoctenamer rubber having a Mooney viscosity of less than 10, available from Evonik Degussa GmbH. | 90 |
| Buna ® CB 23 - polybutadiene rubber having a Mooney viscosity of 52, available from Lanxess Corp. | 10 |
| Zinc diacrylate (ZDA) co-agent | 50 |
| Zinc oxide (ZnO) filler | 13 |

TABLE 1-continued (Core Compositions)

| Core Composition | Concentration (parts per hundred) |
|---|---|
| Perkadox ® BC free-radical initiator | 5 |
| * peroxide free-radical initiator available from Akzo Nobel. | |
| Zinc pentachlorothiophenol (ZnPCTP) | 1 |

Example 2

In this Example, slugs of different polyalkenamer/polybutadiene rubber compositions having the formulations described in Table 2 were cured at different temperature/time cycles as described in Table 3 to make solid, single-layered core samples.

TABLE 2

(Cores-Blends of Polyalkenamer and Polybutadiene Rubber)

| Sample | Base Rubber | Secondary Rubber | ZDA Co-agent (phr) | Peroxide Free-Radical Initiator (phr) | Zinc Oxide Filler (phr) | Soft and Fast Agent (phr) |
|---|---|---|---|---|---|---|
| A | 80 parts Vestenamer 8012 | 20 parts Buna CB 23 | 40 parts SR-526 | 1 part Perkadox BC | 23.5 parts ZnO | 1 part ZnPCTP |
| B | 80 parts Vestenamer 8012 | 20 parts Buna CB 23 | 40 parts SR-526 | 1 part Perkadox BC | 23.5 parts ZnO | 1 part ZnPCTP |
| C | 80 parts Vestenamer 8012 | 20 parts Buna CB 23 | 40 parts SR-526 | 3 parts Perkadox BC | 23.5 parts ZnO | 1 part ZnPCTP |
| D | 80 parts Vestenamer 8012 | 20 parts Buna CB 23 | 40 parts SR-526 | 3 parts Perkadox BC | 23.5 parts ZnO | 1 part ZnPCTP |
| E | 80 parts Vestenamer 8012 | 20 parts Buna CB 23 | 30 parts SR-526 | 1 part Perkadox BC | 26 parts ZnO | 2 parts ZnPCTP |
| F | 80 parts Vestenamer 8012 | 20 parts Buna CB 23 | 30 parts SR-526 | 1 part Perkadox BC | 26 parts ZnO | 2 parts ZnPCTP |
| G | 80 parts Vestenamer 8012 | 20 parts Buna CB 23 | 30 parts SR-526 | 2 parts Perkadox BC | 26 parts ZnO | 2 parts ZnPCTP |
| H | 80 parts Vestenamer 8012 | 20 parts Buna CB 23 | 30 parts SR-526 | 2 parts Perkadox BC | 26 parts ZnO | 2 parts ZnPCTP |

*Vestenamer ® 8012 - polyoctenamer rubber having a trans-content of approximately 80%, a melting point of approximately 54° C., and Mooney viscosity of less than 10, and available from Evonik Degussa GmbH.
*Buna ® CB 23 - polybutadiene rubber having a Mooney viscosity of 52, available from Lanxess Corp.
*SR-526 - zinc diacrylate available from Akzo Nobel NV.
*Varox ® 231-XL - 1,1-di(t-butylperoxy)-3,3,5-trimethylcyclohexane available from Atofina.
*Perkadox ® BC - dicumyl peroxide granules available from Akzo Nobel NV.
*ZnO - zinc oxide
*ZnPCTP - zinc pentachlorothiophenol, available from Strukol Company and Echina

TABLE 3

(Curing Cycle and Properties for Core Samples)

| Sample | Cure Temp (° F.) | Cure Time (Minutes) | DCM (Compression) | COR | Shore D Hardness |
|---|---|---|---|---|---|
| A | 350° F. | 11 Min. | 89 | 0.789 | 51.4 |
| B | 330° F. | 11 Min. | 89 | 0.788 | 51.7 |
| C | 350° F. | 11 Min. | 99 | | 58.9 |
| D | 330° F. | 11 Min. | 96 | | 58.6 |

TABLE 3-continued (Curing Cycle and Properties for Core Samples)

| Sample | Cure Temp (° F.) | Cure Time (Minutes) | DCM (Compression) | COR | Shore D Hardness |
|---|---|---|---|---|---|
| E | 350° F. | 11 Min. | 51 | 0.778 | 43.2 |
| F | 330° F. | 15 Min. | 54 | 0.780 | 44.5 |
| G | 350° F. | 11 Min. | 57 | 0.780 | 46.9 |
| H | 330° F. | 15 Min. | 59 | 0.780 | 48.6 |

As shown in the above Examples, the polyalkenamer/polybutadiene rubber samples showed good compression and COR properties.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted.

It is understood that the compositions and golf ball products described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A golf ball, comprising a core of at least one layer and cover of at least one layer, the core being formed from a rubber composition comprising:

a) about 1 to about 49 weight percent of a polybutadiene rubber having a Mooney viscosity in the range of about 50 to about 150; and b) about 51 to about 99 weight percent of a cycloalkene rubber having a trans-content of about 55% or greater, a melting point of 30° C. or greater, and a Mooney viscosity of less than about 10.

2. The golf ball of claim 1, wherein the rubber composition further comprises peroxide in an amount of 2.5 phr or greater based on total weight of rubber.

3. The golf ball of claim 1, wherein the cycloalkene rubber has a trans-content of 75% or greater and a melting point of 50° C. or greater.

4. The golf ball of claim 1, wherein the polybutadiene rubber has a Mooney viscosity in the range of about 60 to about 130.

5. The golf ball of claim 4, wherein the polybutadiene rubber has a Mooney viscosity in the range of about 70 to about 105.

6. The golf ball of claim 1, wherein the diameter of the core is in the range of about 1.51 to about 1.59 inches.

7. The golf ball of claim 1, wherein the thickness of the cover is in the range of about 0.015 to about 0.090 inches.

8. The golf ball of claim 1, wherein the cover comprises an inner cover layer and outer cover layer.

9. The golf ball of claim 8, wherein the hardness of the inner cover layer is greater than the hardness of the outer cover layer.

10. The golf ball of claim 9, wherein the inner cover layer is formed from a composition comprising an ionomeric resin and the outer cover layer is formed from a composition comprising a material selected from the group consisting of polyurethane; polyurea; and a hybrid, copolymer, or blend of polyurethane and polyurea.

11. The golf ball of claim 1, wherein the golf ball has a compression in the range of about 40 to about 110 and a COR of about 0.76 or greater.

12. A golf ball comprising:

a core comprising an inner core and outer core layer, wherein the outer core layer is disposed about the inner core layer, the core having an overall diameter of about 1.40 to about 1.60 inches;

an intermediate layer having a thickness of about 0.015 inches to about 0.120 inches and surface hardness of about 45 to about 75 Shore D;

a cover having a thickness of about 0.015 inches to about 0.090 inches and surface hardness of about 40 to about 65 Shore D;

wherein at least one of the inner core and outer core layer is formed from a rubber composition comprising: a) about 1 to about 49 weight percent of a polybutadiene rubber having a Mooney viscosity in the range of about 50 to about 150; and b) about 51 to about 99 weight percent of a cycloalkene rubber having a trans-content of about 55% or greater, a melting point of 30° C. or greater, and a Mooney viscosity of less than about 10.

13. The golf ball of claim 12, wherein the inner core is formed from the rubber composition.

14. The golf ball of claim 12, wherein the outer core layer is formed from the rubber composition.

15. The golf ball of claim 12, wherein the rubber composition further comprises peroxide in an amount of 2.5 phr or greater based on total weight of rubber.

16. The golf ball of claim 12, wherein the cycloalkene rubber has a trans-content of 75% or greater and a melting point of 50° C. or greater.

17. The golf ball of claim 12, wherein the polybutadiene rubber has a Mooney viscosity in the range of about 60 to about 130.

18. The golf ball of claim 17, wherein the polybutadiene rubber has a Mooney viscosity in the range of about 70 to about 105.

19. The golf ball of claim 12, wherein the cover comprises an inner cover layer and outer cover layer.

20. The golf ball of claim 12, wherein the inner cover layer is formed from a composition comprising an ionomeric resin and the outer cover layer is formed from a composition comprising a material selected from the group consisting of polyurethane; polyurea; and hybrid, copolymer, or blend of polyurethane and polyurea.

* * * * *